US005288243A

United States Patent [19]

Mergless

[11] Patent Number: 5,288,243

[45] Date of Patent: * Feb. 22, 1994

[54] ELECTRICAL CONNECTOR

[75] Inventor: James E. Mergless, Utica, Mich.

[73] Assignee: Omega Special Products, Inc., Mount Clemens, Mich.

[ * ] Notice: The portion of the term of this patent subsequent to Jun. 9, 2009 has been disclaimed.

[21] Appl. No.: 818,869

[22] Filed: Jan. 10, 1992

Related U.S. Application Data

[63] Continuation-in-part of Ser. No. 658,260, Feb. 20, 1991, Pat. No. 5,120,234.

[51] Int. Cl.[5] ..... H01R 13/627; H01R 13/42; H01R 13/64

[52] U.S. Cl. ..... 439/357; 439/595; 439/598; 439/680

[58] Field of Search ..... 439/357, 358, 592-595, 439/603, 680, 744, 748

[56] References Cited

U.S. PATENT DOCUMENTS

| | | |
|---|---|---|
| 3,824,523 | 7/1974 | McGhee . |
| 3,838,382 | 9/1974 | Sugar . |
| 3,941,444 | 3/1976 | Bruni et al. . |
| 3,982,805 | 9/1976 | Irie . |
| 4,127,314 | 11/1978 | Hasimoto . |
| 4,311,355 | 1/1982 | Plyler et al. . |
| 4,571,017 | 2/1986 | Fujita . |
| 4,660,915 | 4/1987 | Mantlik . |
| 4,714,437 | 12/1987 | Dyki . |
| 4,784,617 | 11/1988 | Oda . |
| 4,797,116 | 1/1989 | Isohata et al. . |
| 4,802,867 | 2/1989 | Palmer . |
| 4,806,123 | 2/1989 | Konishi et al. . |
| 4,826,452 | 5/1989 | Sian et al. . |
| 4,891,021 | 1/1990 | Hayes et al. . |
| 4,900,271 | 2/1990 | Colleran et al. . |
| 4,973,266 | 11/1990 | Bullard . |
| 5,120,234 | 6/1992 | Mergless ..... 439/598 |

*Primary Examiner*—Paula A. Bradley
*Attorney, Agent, or Firm*—Harness, Dickey & Pierce

[57] ABSTRACT

A releasably coupleable electrical connector assembly generally comprising first and second, mating, tubular connectors. The first tubular connector includes a generally square, elongated, tubular body portion and a locking tab catch portion. An inner surface of the body portion of the first tubular connector includes a protruding shoulder portion which is operable to engage with a shoulder portion of an elongated, electrical terminal pin to thereby hold the terminal pin captively and securely within the body portion after the terminal pin has been inserted therein. The second tubular connector includes a generally square, elongated tubular body portion and a planar, elongated tongue-like element having a tab element protruding therefrom. The body portion of the second tubular connector further includes an internal locking shoulder portion for lockably engaging with a mating electrical terminal after the terminal pin is inserted within the body portion of the second tubular connector, to thereby captively and securely hold the mating electrical terminal therewithin. The tubular connectors are coupled together by slidably inserting the body portion of the second tubular connector within the body portion of the first tubular connector. This causes the electrical terminal pin to be inserted within the mating electrical terminal, and the tab element of the planar, elongated tongue portion to be releasably, lockably engaged with the locking tab catch portion of the first tubular connector. Uncoupling is accomplished by simply lifting up on the locking tab catch portion and slidably removing the second tubular connector from the first tubular connector.

8 Claims, 6 Drawing Sheets

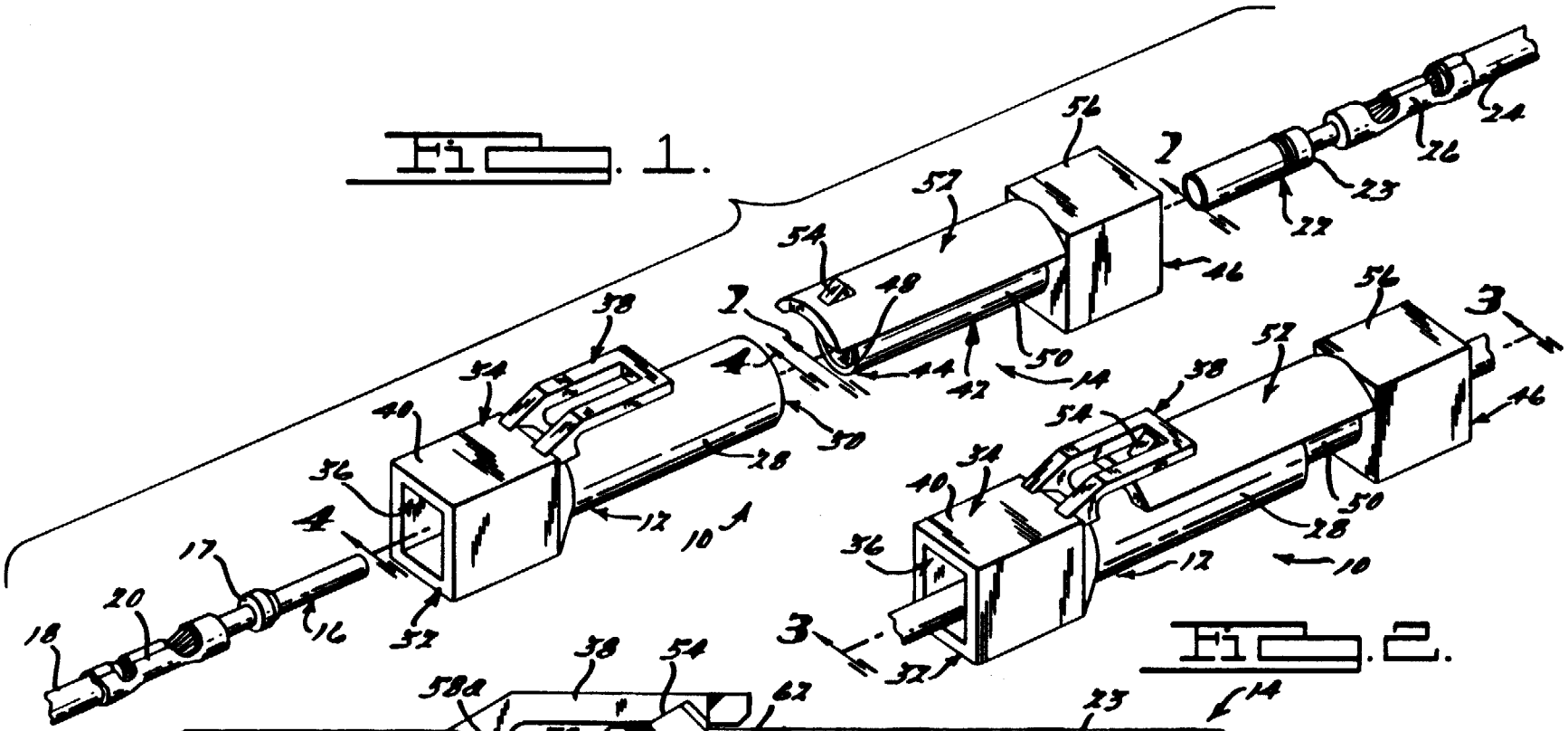
FIG. 1.
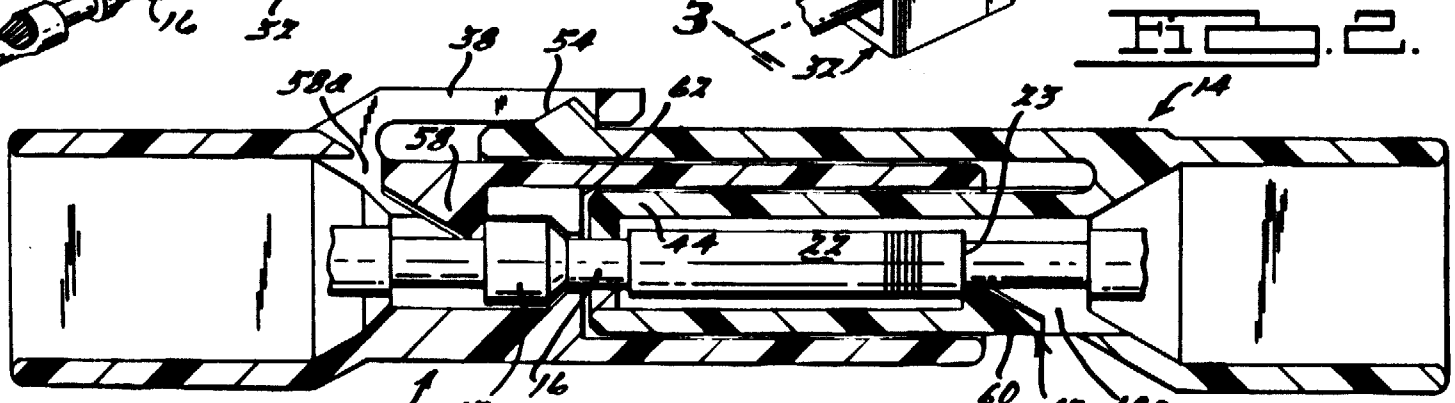
FIG. 2.
FIG. 3.

ELECTRICAL CONNECTOR

CROSS REFERENCE TO RELATED APPLICATION

The present application is a continuation-in-part of U.S. patent application Ser. No. 07/658,260, filed Feb. 20, 1991, which issued on Jun. 9, 1992 as U.S. Pat. No. 120,234.

BACKGROUND OF THE INVENTION

Technical Field

This invention relates to electrical connector assemblies, and more particularly to a releasably coupled electrical connector assembly having first and second independent electrical connectors and locking tab and catch portions to enable the two independent connectors to be releasably, securely coupled together in mating electrical and mechanical engagement.

Discussion

Electrical connector assemblies are used in a wide variety of applications where it is necessary to make releasable, electrical connections between electrical conductors such as electrically conductive wires. Heretofore, such connector assemblies have suffered from a variety of drawbacks which limit their efficacy in many wiring applications. For example, in many applications electrical wires must be releasably coupled together in a secure fashion to insure that continuity between the wires will not be interrupted in the event of vibration, jarring, etc.

In many such applications as just described above, it is also important that the wires may be uncoupled quickly, easily and without the need for tools such as pliers, vice grips and/or needle nose pliers. It is also desirable that such a connector assembly be adapted for use with conventional electrical terminal elements rather than requiring specially fabricated terminal.

Accordingly, it is a principal object of the present invention to provide an electrical connector assembly capable of being quickly, easily and efficiently releasably coupled to secure a pair of electrical conductors such as wires in secure, electrical contact.

It is a further object of the present invention to provide an electrical connector assembly which may be quickly, easily and conveniently releasably uncoupled without the aid of tools such as pliers, vice grips, etc.

It is still a further object of the present invention to provide an electrical connector assembly which will maintain electrical contact between a pair of electrical conductors even in applications where vibration, jarring, and other like stresses could cause heretofore developed connector assemblies to become uncoupled either permanently or temporarily.

It is yet another object of the present invention to provide an electrical connector assembly which is relatively unaffected by hot or cold ambient conditions, as well as humidity.

It is still another object of the present invention to provide an electrical connector assembly which is light in weight, strong, durable, and relatively inexpensive to manufacture.

SUMMARY OF THE INVENTION

The above and other objects are provided by an electrical connector assembly in accordance with the present invention. The connector assembly generally comprises first and second tubular connectors. The first tubular connector includes inner and outer end portions, an elongated tubular body portion and an outwardly protruding locking tab catch portion. The body portion of the first tubular connector further includes inner and outer surfaces, with the inner surface including a protruding, internal locking shoulder portion operable to engage with a shoulder portion of a conventional, elongated electrical terminal pin to thereby securely and captively hold the terminal pin therein.

The second tubular connector has inner and outer end portions and an elongated, tubular body portion. Further included is an elongated, arcuate, tongue-like portion having a tab element protruding therefrom. The body portion of the second tubular connector further includes inner and outer surfaces, with the inner surface further including a protruding, internal locking shoulder portion which is operable to engage with a shoulder portion of a conventional, tubular electrical terminal inserted within the body portion through the outer end of the second tubular connector. The internal locking shoulder portion of the second tubular connector enables the tubular electrical terminal to be held securely and captively within a second tubular connector.

To electrically and mechanically couple the first and second tubular connectors, the body portion of the second tubular connector is inserted within the body portion of the first tubular connector. This causes the electrical terminal pin within the first tubular connector to matingly engage the tubular electrical terminal within the second tubular connector. As the first and second tubular connectors are slidably and matingly coupled together, the tab element of the tongue-like element of the second tubular terminal abuttingly engages with the locking tab catch portion of the first tubular connector, to thereby releasably, lockably secure the first and second tubular connectors in mating engagement.

To separate the first and second tubular connectors, the locking tab catch portion of the first tubular connector is lifted upwardly and the first and second tubular connectors are slidably disengaged, thereby causing the electrical terminal pin of the first tubular connector to be slidably withdrawn from the tubular electrical terminal of the second tubular connector.

In a preferred embodiment of the present invention, the body portion of the first tubular connector further comprises a slot therein extending from its inner end portion part way along the body portion. The second tubular connector further comprises an outwardly protruding, elongated rib portion extending at least part way along its body portion, and generally parallel to the longitudinal axis of the body portion. The rib portion and slot form a key-like arrangement which, when first and second tubular connectors are coupled together, prevents the connectors from rotating axially relative to each other.

In an alternative preferred embodiment of the present invention a first tubular connector comprises a generally square shape and is adapted to releasably lockably secure therein an electrical terminal pin. The second tubular connector also comprises portions which are generally square in shape and is adapted to lockably secure therein a mating electrical terminal.

BRIEF DESCRIPTION OF THE DRAWINGS

The various advantages of the present invention will become apparent to one skilled in the art by reading the following specification and subjoined claims and by referencing the following drawings in which:

FIG. 1 is an exploded perspective view of the first and second tubular connectors of the present invention, together with a conventional electrical contact pin and a conventional tubular electrical contact;

FIG. 2 is a perspective view of the electrical connector assembly of the present invention showing the first and second tubular connectors of the present invention in assembly relation;

FIG. 3 is a cross-sectional view of the connector assembly of the present invention in assembly relation, and shown along section lines 3—3 of FIG. 1;

DETAILED DESCRIPTION OF THE PREFERRED EMBODIMENTS

Figure 4:
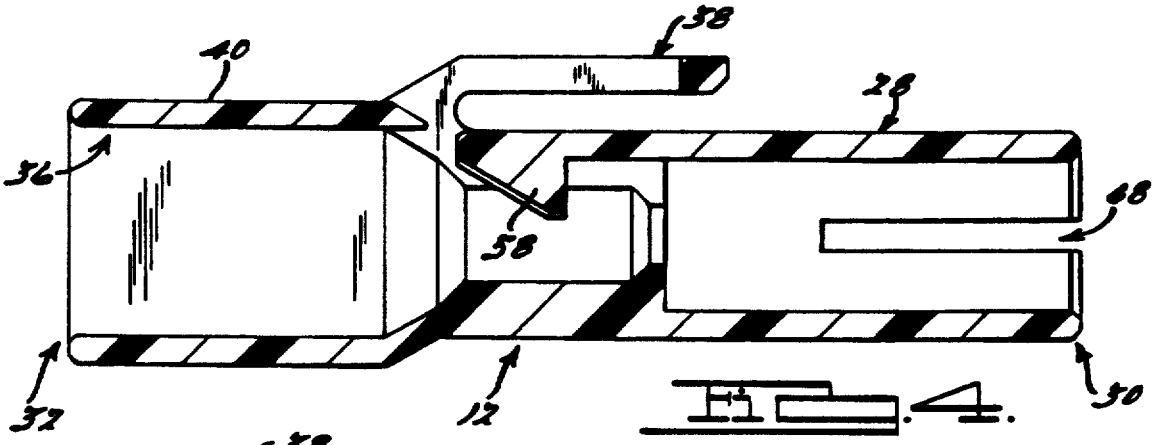
FIG. 4 is a cross-sectional view of the first tubular connector taken along section lines 4—4 of FIG. 1, and without an electrical contact pin lockably secured therein.

Referring now to FIG. 1, there is shown an electrical connector assembly 10 in accordance with the present invention. The connector assembly 10 generally comprises a first, elongated tubular connector 12 and a second, mating, elongated, tubular connector 14. Also shown in FIG. 1 is an elongated, electrical terminal pin 16 having a shoulder portion 17. The terminal pin 16 is coupled to a first electrical conductor 18, illustrated as a wire, via crimp-on connector 20. An elongated, tubular electrical terminal 22 having a shoulder portion 23 is also shown in FIG. 1 coupled to a second electrical conductor 24, also illustrated as a wire, via a crimp on electrical connector 26.

The first tubular connector 12 further comprises an elongated tubular body portion 28 and inner and outer end portions 30 and 32 respectively. The first tubular connector further includes an outer surface 34, an inner surface 36, and a protruding, locking tab catch portion 38 protruding from a portion of the outer surface 34.

The outer end portion 32 of the first tubular connector is comprised of a grippable, enlarged end portion 40 having a generally square shape. Grippable end portion 40 facilitates manual gripping of first tubular connector 12 to facilitate easy connecting and disconnecting of connector 12 with second tubular connector 14. It should be appreciated, however, that grippable, enlarged end portion 40 need not be square-shaped but rather may instead take the shape of a wide variety of forms which facilitate quick and easy manual handling of first tubular connector 12.

With further reference to FIG. the second tubular connector 14 comprises an elongated tubular body portion 42 and inner and outer end portions 44 and 46 respectively. The tubular body portion 42 includes an inner surface 48 and an outer surface 50. Disposed closely adjacent the outer surface 50 of tubular body portion 42 is an arcuate, elongated, tongue-like portion 52 having a tab element 54 protruding therefrom.

The outer end portion 46 of second tubular connector 14 also comprises a grippable, enlarged end portion 56 having a generally square shape. Like grippable end portion 40 of first tubular connector 12, the grippable end portion 56 need not be square in shape but could take the form of a variety of alternate shapes if so desired. The generally square shape of grippable end portion 56, however, enables end portion 56 to be easily and securely gripped with the fingers of a single hand to thereby help facilitate easy manual manipulation of second tubular connector 14.

With reference now to FIGS. 2 and 3, the mating engagement of the connector assembly 10 will be described. Initially, however, specific reference should be made to FIG. 3, wherein an internal, locking shoulder portion 58 can be clearly seen within first tubular connector 12, and an internal, locking shoulder portion 60 can be clearly seen within second tubular connector 14. The internal locking shoulder portion 58 is integrally formed with tubular body portion 28 of the first tubular connector 12 via a cut-out section 58*a* (shown more clearly in FIG. 10), and operates to abuttingly engage shoulder portion 17 of elongated electrical terminal pin 16 after terminal pin 16 is slidably inserted into the outer end portion 32 of the first tubular connector 12. Accordingly, internal locking shoulder portion 58 operates to captively secure terminal pin 16 within tubular body portion 28 after terminal pin 16 has been inserted into first tubular connector 12. Cut-out section 58a, conversely, enables terminal pin 16 to be removed by lifting shoulder portion 58 up while the terminal pin 16 is removed from body portion 28.

The internal locking shoulder portion 60 within second tubular connector 14 is integrally formed with a portion of tubular body portion 42 via cut-out portion 60a, and operates to abuttingly engage shoulder portion 23 of tubular electrical terminal 22 after terminal 22 is slidably inserted into the outer end portion 46 of second tubular connector 14. Accordingly, after tubular electrical terminal 22 is slidably inserted into the tubular body portion 42, it will be captively held therein by internal locking shoulder portion 60 to prevent it from being accidentally pulled out. Cut-out portion 60a also enables shoulder portion 60 to be lifted up and tubular electrical terminal 22 to be slidably removed from body portion 42.

As can be seen from FIGS. 2 and 3, and most particularly FIG. 3, the first and second tubular connectors 12 and 14 respectively are matingly coupled together by sliding the tubular body portion 42 of the second tubular connector 14 into the tubular body portion 28 of first tubular connector 12. The inner end portion 44 of the second tubular connector 14 is limited in its inward travel by an internal wall portion 62 of first tubular connector 12.

As the tubular body portion 42 of second tubular connector 12 is slidably inserted into body portion 28 of first tubular connector 12, arcuate tongue-like portion 52 extends over the outer surface of tubular body portion 28 and is urged underneath locking tab catch portion 38. As the inner end portion 44 of body portion 42 nears the end of its inward travel, tab element 54 of tongue-like portion 52 engages locking tab catch portion 38, pushing it upwardly before sliding underneath it to become releasably, lockably secured therein. Accordingly, the first and second tubular connector portions 12 and 14 respectively are lockably, releasably coupled in mating engagement via tab element 54 of second tubular connector 14 and locking tab catch portion 38 of the first tubular connector 12. An electrical connection between terminal pin 16 and tubular terminal 22 is also simultaneously made as the first and second tubular connectors 12 and 14 respectively are matingly coupled together. Specifically, as the first and second tubular connectors 12 and 14 are coupled together, terminal pin 16 is caused to slidably, matingly enter tubular electrical terminal 22. Accordingly, when the first and second tubular connectors 12 and 14 respectively are lockably matingly engaged, the terminal pin 16 and tubular terminal 22 will also be held together in locking engagement, thereby providing a continuous path by which electrical current may flow through conductors 18 and 24.

From FIG. 3, a further benefit of the system 10 is apparent. Cut-out portion 58a serves to enable internal locking shoulder portion 58 to flex upwardly and downwardly slightly to thereby enable the shoulder portion 17 of terminal pin 16 to be more easily inserted past shoulder portion 58. When the first and second tubular connectors are matingly engaged, however, the arcuate, tongue-like portion 52 extends over internal locking shoulder portion 58, and underneath locking tab catch portion 38, thereby preventing any upward movement of shoulder portion 58 in response to vibration, jarring, etc., while the first and second tubular connectors 12 and 14 are coupled matingly together. Accordingly, terminal pin 16 is held securely within body portion 28 while the first and second tubular connectors 12 and 14 are coupled together.

Cut-out portion 60a similarly serves to permit the internal locking shoulder portion 60 of body portion 42 to move inwardly and outwardly slightly to thereby enable the tubular electrical terminal 22 to be more easily inserted and removed from body portion 42. However, when the second tubular connector 14 is matingly engaged with the first tubular connector 12, the tubular body portion 28 of the first tubular connector 12 circumscribes the body portion 42 of the second tubular connector 14, thereby preventing internal locking shoulder portion 60 from being inadvertently urged outwardly by vibration, jarring, etc. Accordingly, internal locking shoulder portion 60 is held securely in place by tubular body portion 28 of first tubular connector 12 to thereby securely hold tubular terminal 22 captively within the body portion 42 of the second tubular connector 14.

With further reference to FIGS. 1-3, uncoupling of the connector assembly 10 is effected by lifting up on locking tab catch portion 38, gripping the grippable, enlarged end portion 40 of the first tubular connector 12, and the enlarged, grippable end portion 56 of the second tubular connector 14, and then slidably urging the first and second tubular connectors 12 and 14 respectively away from each other. This simultaneously causes the terminal pin 1 and tubular terminal 22 to become slidably disengaged.

Referring now to FIG. 4, an additional feature of the present invention can be seen. The first tubular connector 12 further comprises a slot 68 in its tubular body portion 28 which extends from the inner end portion 30 in a direction parallel to the longitudinal axis of the second tubular connector 12. Although the slot 68 is shown extending approximately one-half of the distance into tubular body portion 28, slot 68 need not be this long but rather may only extend along the tubular body portion 28 for a very short distance. The slot 68 serves as a "key-way" to receive an elongated, protruding rib portion 70, shown in FIG. 8, therein when the first and second tubular connectors 12 and 14 respectively are matingly coupled together. Rib portion 70 and slot 68 thus form a key-like arrangement to further prevent the second tubular connector 14 from rotating axially relative to the first tubular connector 12 when the two connectors 12 and 14 are coupled together.

Figure 5:
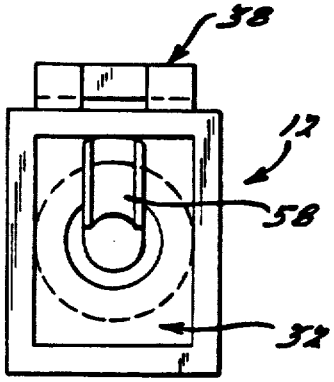
FIG. 5 is an elevational end view of the first tubular connector as seen from its outer end portion.
Figure 6:
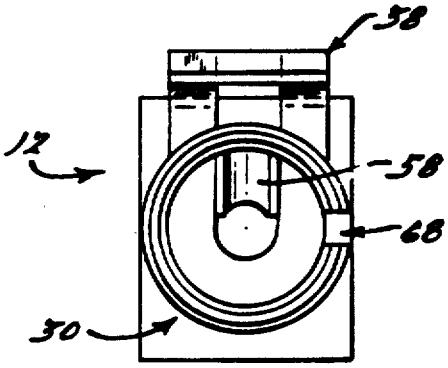
FIG. 6 is an elevational end view of the first tubular connector as seen from its inner end portion.

Referring now to FIGS. 5 and 6, views from the outer end portion 32 of the first tubular connector 12 (FIG. 5) and from the inner end portion 30 of tubular connector 12 (FIG. 6) can be seen. FIG. 5 illustrates clearly the internal locking shoulder portion 58, while FIG. 6 also illustrates the internal locking shoulder portion 58, as well as slot 68.

Figure 7:
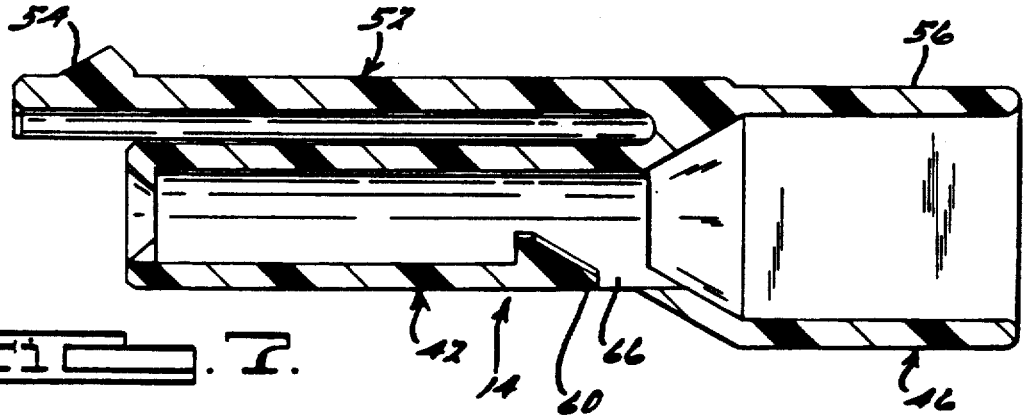
FIG. 7 is a cross-sectional view of the second tubular connector taken along section lines 7—7 of FIG. 1, and without the electrical contact secured therein.
Figure 8:
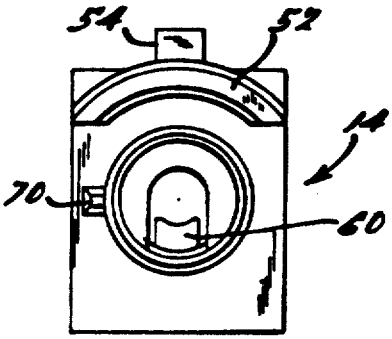
FIG. 8 is an elevational end view of the second tubular connector as seen from the inner end of the second tubular connector.
Figure 9:
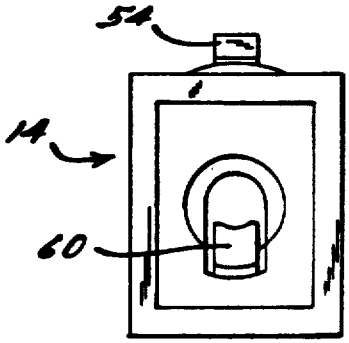
FIG. 9 is an elevational end view of the second tubular connector as seen from the outer end of the second tubular connector.
Figure 10:
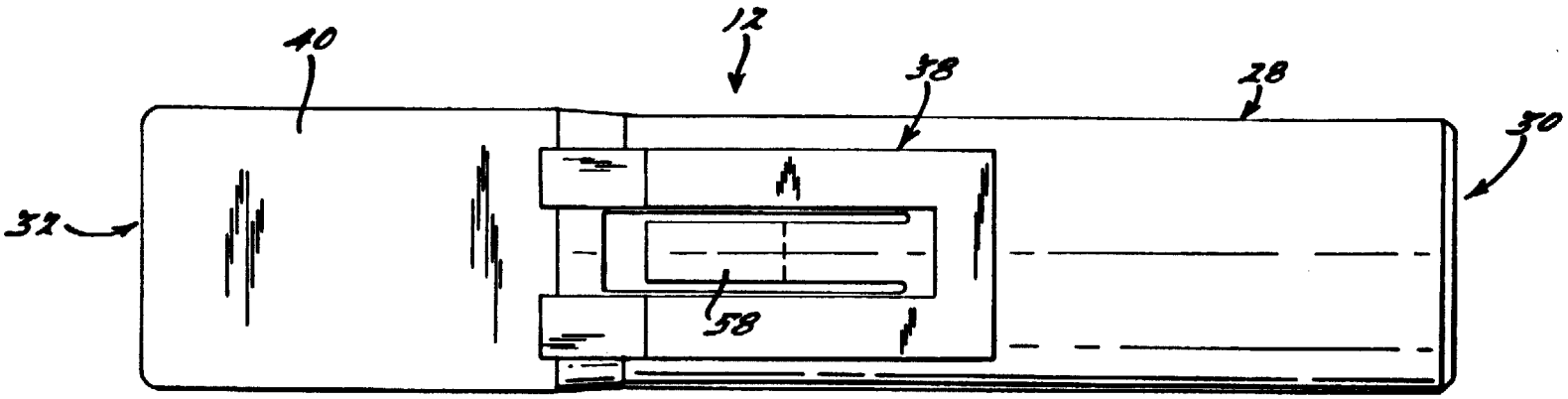
FIG. 10 is an elevational plan view of the first tubular connector.
Figure 11:
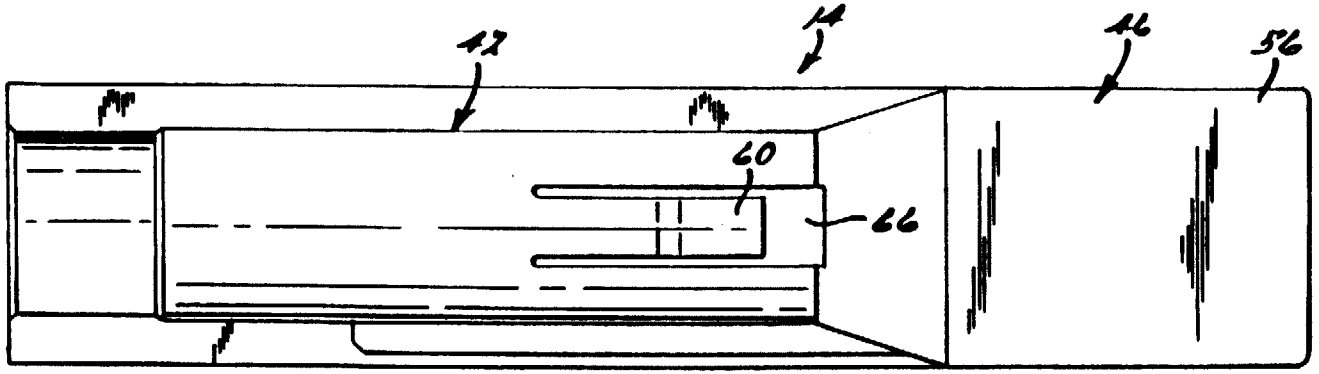
FIG. 11 is an elevational bottom view of the second tubular connector.

With reference to FIGS. 7-9, the various features of the second tubular connector 14 can be seen more clearly. Specifically, FIG. 8 illustrates most clearly the protruding rib portion 70 and the arcuate, elongated, tongue-like portion 52. FIG. 9 illustrates more clearly the internal locking shoulder portion 60. FIGS. 10 and 11 show more clearly the cut-out sections 58a and 60a of the first tubular connector 12 and the second tubular connector 14 respectively.

Figure 12:
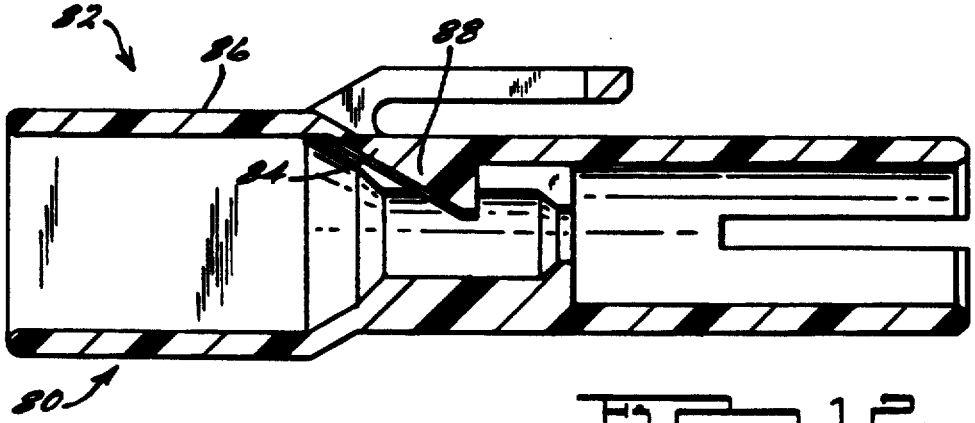
FIG. 12 is a cross-sectional side view of an alternative preferred embodiment of the present invention illustrating a leaf beam incorporated to further help facilitate insertion and retention of the terminal pin.
Figure 13:
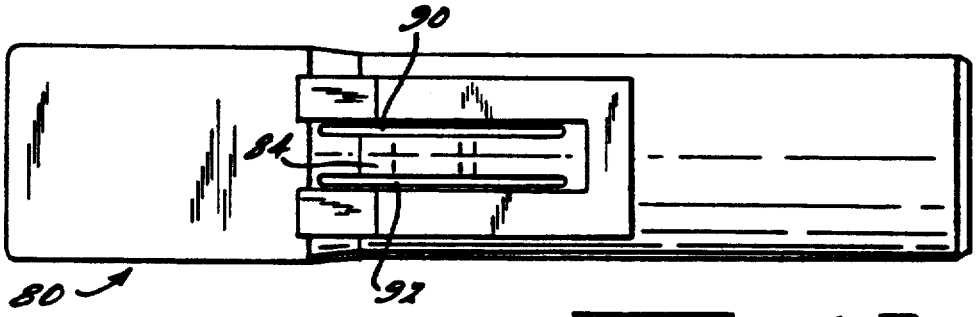
FIG. 13 is an elevational plan view of the alternative preferred embodiment of FIG. 12.

Referring now to FIGS. 12 and 13, a first tubular connector 80 of an alternative preferred embodiment 82 of the present invention is shown. This first tubular connector 80 is substantially identical to the first tubular connector 12, with the exception of a leaf beam 84 which is integrally formed in between a grippable end portion 86 and internal locking shoulder portion 88. Further helping to form the leaf beam 84 are a plurality of elongated cut-out slots 90 and 92, as best seen from the plan view of FIG. 13.

The leaf beam 84 enables a terminal pin (not shown) to be more positively inserted and more positively retained by internal locking shoulder portion 88 within the first tubular connector 80 after being inserted therein.

Figure 14:
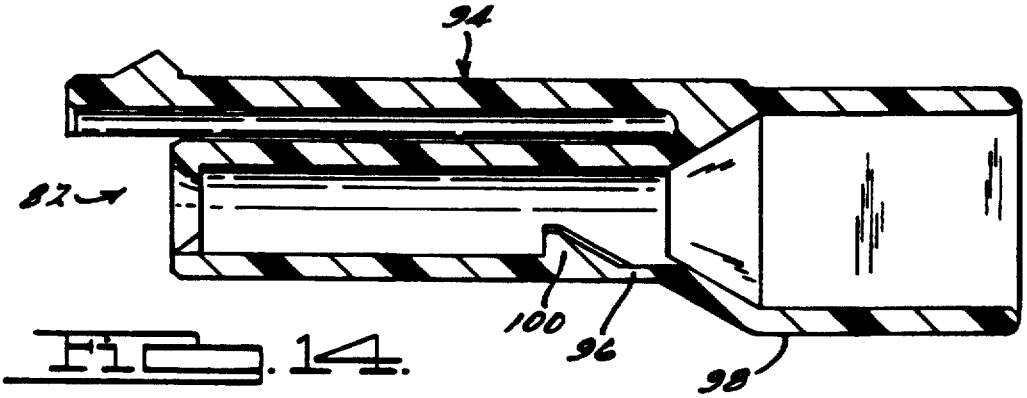
FIG. 14 is a cross-sectional side view of an alternative preferred embodiment of the present invention illustrating a leaf beam incorporated to further help facilitate insertion and retention of the tubular electrical terminal.
Figure 15:
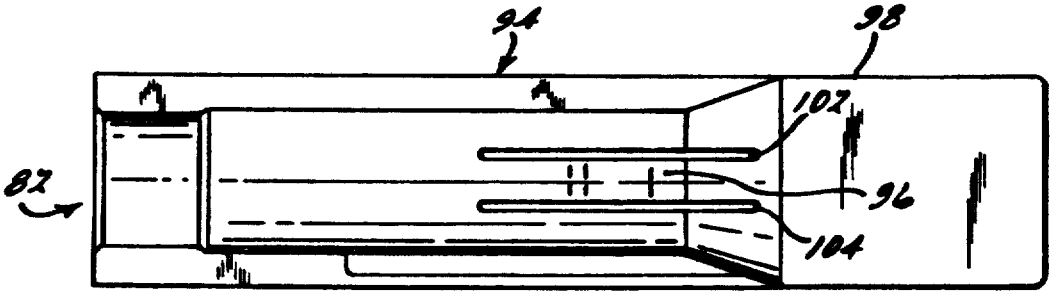
FIG. 15 is an elevational bottom view of the alternative preferred embodiment of FIG. 14.

With reference now to FIGS. 14 and 15, a second tubular connector 94 in accordance with the alternative preferred embodiment 82 of the present invention is shown. This second tubular connector 94 is substantially identical to the second tubular connector 14 discussed hereinbefore, with the exception of a leaf beam 96 which is integrally formed in between a portion of a grippable, enlarged end portion 98 and an internal locking shoulder portion 100. The leaf beam 96 is further partially formed by elongated cut-out slots 102 and 104, best illustrated in FIG. 15.

Leaf beam 96 functions similarly to leaf beam 84 in that leaf beam 96 enables a tubular electrical terminal (not shown), such as tubular electrical connector 22, illustrated in FIG. 1, to be positively slidably inserted within the second tubular connector 94 and positively retained therein by the internal locking shoulder portion 100.

Figure 16:
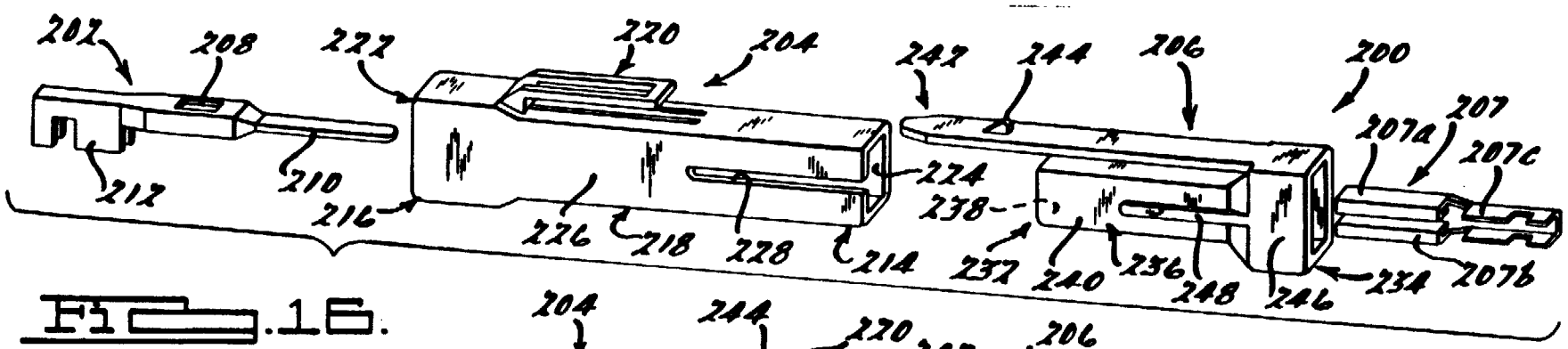
FIG. 16 is an exploded perspective view of an electrical connector in accordance with an alternative preferred embodiment of the present invention.

Referring now to FIG. 16, there is shown an electrical connector assembly 200 in accordance with an alternative preferred embodiment of the present invention. The connector assembly 200 generally comprises an elongated, electrical terminal pin 202, a first tubular connector 204, a second tubular connector 206, and a mating electrical terminal 207.

The electrical terminal pin 202 is widely commercially available and includes a slot 208 and a tongue portion 210. A connecting portion 212 of the terminal pin 202 is adapted to be crimped over an end of a conductor (not shown) in conventional fashion.

The first tubular connector 204 generally includes inner and outer end portions 214 and 216 respectively, an elongated, generally square-shaped, tubular body portion 218, a protruding, integrally formed and spaced apart locking tab catch portion 220 and a generally square-shaped, grippable, enlarged end portion 222. The elongated tubular body portion 218 further includes interior and exterior surfaces 224 and 226 respectively, and a slot 228 extending from the inner end portion 214 part way along the elongated tubular body portion 218. With brief reference to FIG. 18, the elongated tubular body portion 218 further includes a protruding, internal locking shoulder portion 230.

With continuing reference to FIG. 16, the second tubular connector 206 generally includes inner and outer end portions 232 and 234 respectively, a generally square-shaped, elongated tubular body portion 236 having inner and outer surfaces 238 and 240 respectively, and a planar, elongated tongue-like element 242. The elongated tongue-like element 242 includes a tab element 244 and is integrally formed with a generally square-shaped, grippable, enlarged end portion 246. The elongated tongue-like element is further integrally formed so as to be partially spaced laterally apart from the elongated tubular body portion 236. The elongated tubular body portion 236 and the grippable, enlarged end portion 246 further include an elongated, protruding rib portion 248 integrally formed therewith and extending partially along the longitudinal length of body portion 236.

As illustrated in FIG. 16 the mating electrical connector 207 includes a pair of arm portions 207*a* and 207*b*, and a connecting portion 207*c*. The connecting portion 207*c* is adapted to be crimped over a portion of a conductor (not shown). The arm portions 207*a* and 207*b* are adapted to receive abuttingly therebetween the tongue portion 210 of electrical terminal pin 202, as will be described further hereinafter.

Figure 17:
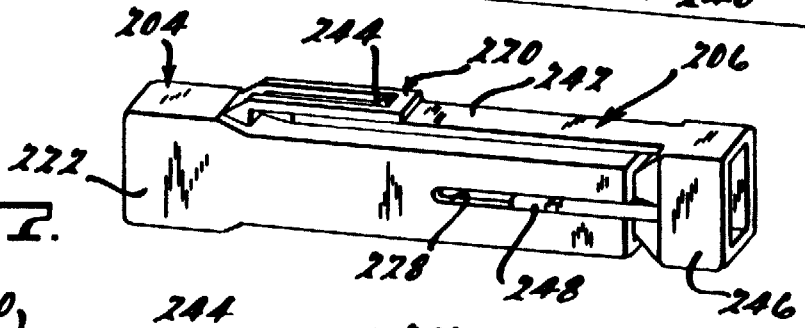
FIG. 17 is a perspective view of the electrical connector of FIG. 16 showing the components thereof releasably coupled together.

Referring briefly to FIG. 17, the connector 200 of FIG. 16 can be seen with the first and second tubular connectors 204 and 206 coupled releasably, matingly together. To connect connectors 204 and 206 the first tubular connector 204 is slidably urged over the tubular body portion 236 of the second tubular connector 206 causing the protruding, locking tab catch portion 220 to ride over tab element 244 on the elongated, tongue-like element 242. The elongated, protruding rib portion 248 further becomes disposed within the slot 228 as the two connectors 204 and 206 are coupled together, thereby further ensuring against axial rotation of one connector 204 or 206 relative to the other. When the first tubular connector 204 is inserted completely over elongated tubular body portion 236 of the second tubular connector 206, the tab element 244 releasably, lockably engages with the locking tab catch portion 220 to releasably, lockably secure the first and second tubular connectors 204 and 206, respectively, together.

Figure 18:
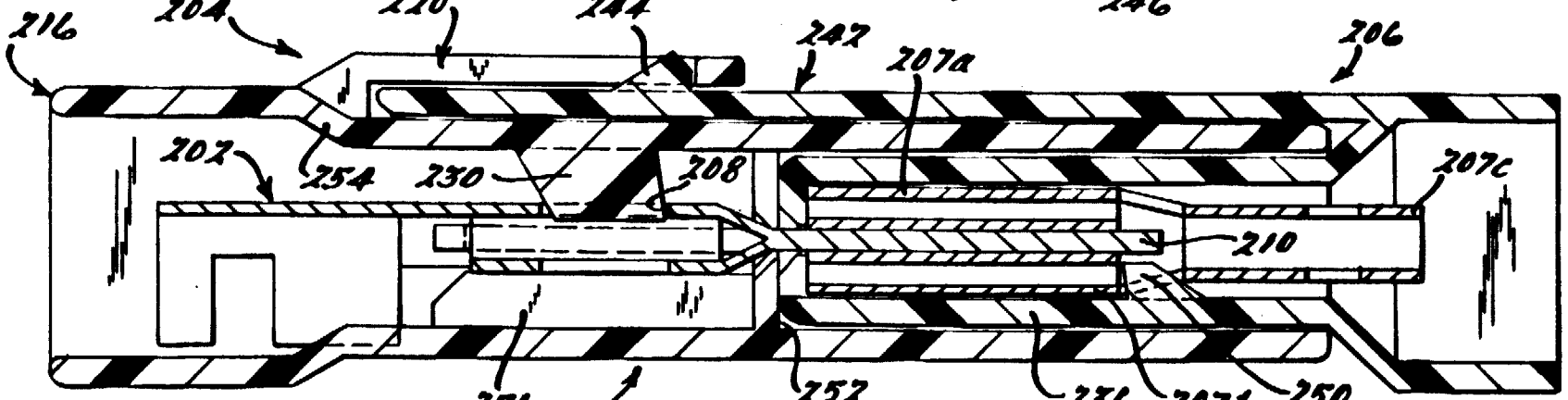
FIG. 18 is a cross-sectional side view of the connector of FIG. 17 showing the components of the connector releasably coupled together.

Referring now to FIG. 18, it can further be seen how the electrical terminal pin 22 and mating electrical connector 207 are secured within the first and second tubular connectors 204 and 206 respectively. The internal locking shoulder portion 230 of the first tubular connector 204 is adapted to lockably engage with the slot 208 of the electrical terminal pin 202 as the terminal pin 202 is slidably inserted into the outer end portion 216 of the first tubular connector 204. The internal locking shoulder portion 230 operates to lockably secure the electrical terminal pin 202 within the first tubular connector 204.

With further reference to FIG. 18, the second tubular connector 206 includes an internal locking shoulder portion 250 which is adapted to abuttingly engage with arm portion 207*b* of the mating electrical connector 207 when the connector 207 is slidably inserted into the outer end portion 234 of the second tubular connector 206. The internal locking shoulder portion 250 thus lockably secures the mating electrical terminal 207 within the second tubular connector 206.

The first tubular connector 204 further includes an internal wall portion 252 which operates to act as a positive stop to limit the inward travel of the tubular body portion 236 of the second tubular connector 206 when the first and second tubular connectors 204 and 206 are slidably coupled together.

Figure 19:
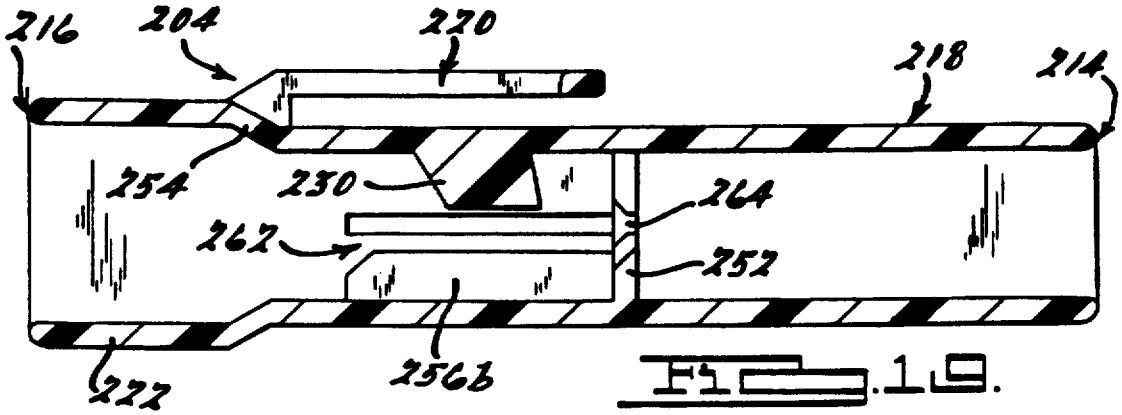
FIG. 19 is a cross-sectional side view of a first tubular connector of the embodiment of FIG. 18.

With further reference to FIG. 18 and also to FIG. 19, it can be seen that the first tubular connector 204 includes a leaf beam portion 254 which operates in a manner substantially identical to the leaf beams 84 and 96 of FIGS. 12-15 to enable the electrical terminal pin 202 to be more positively slidably inserted within the first tubular connector 204.

Figure 20:
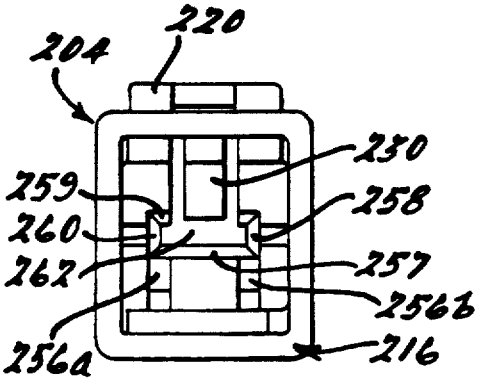
FIG. 20 is an end view of the first tubular connector of FIG. 19 as viewed from an outer end portion thereof.
Figure 21:
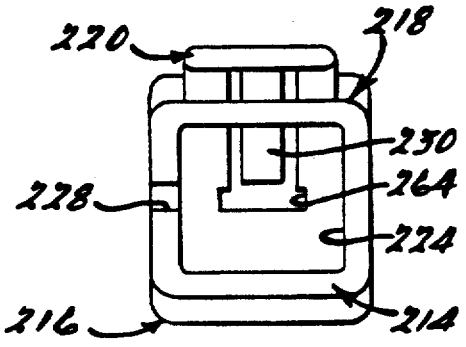
FIG. 21 is an end view of the first tubular connector of FIG. 19 as viewed from an inner end portion thereof.

With reference to FIGS. 19 and 20, it can also be seen that the first tubular connector 204 includes shoulder portions 256a and 256b for supporting the electrical terminal pin 202 and for partially defining a slot 262 into which the electrical terminal pin 202 may be partially inserted. The slot 262 is longitudinally aligned with tapered portions 257, 258, 259 and 260, which form an opening 264 in the internal wall portion 252. The opening 264 is preferably of slightly larger dimensions than the tongue-like portion 210 of the electrical terminal pin 202 to enable the tongue-like portion 210 to be inserted therethrough as the electrical terminal pin 204 is being inserted within the first tubular connector 204. With brief reference to FIG. 21, the opening 264 can be seen from the opposite viewpoint (i.e., looking inwardly into the connector 204 from the inner end portion 214 of the connector 204.

Figure 22:
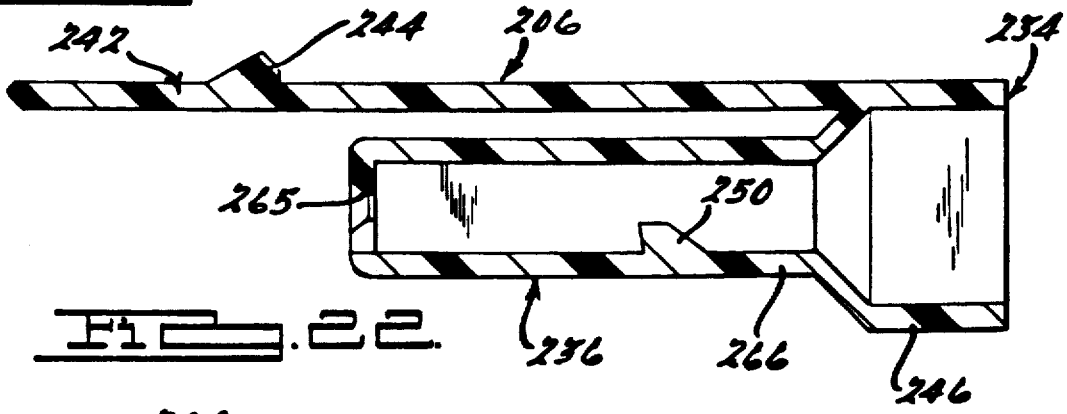
FIG. 22 is a cross-sectional side view of a second tubular connector of the embodiment of FIG. 18.
Figure 23:
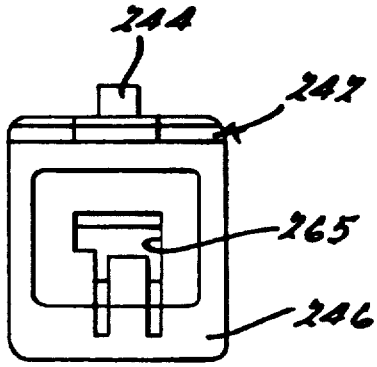
FIG. 23 is an end view of the second tubular connector of FIG. 22 as viewed from an inner end portion thereof.

Referring now to FIGS. 22 and 23, it can be seen that the elongated tubular body portion 236 of the second tubular connector 206 includes an opening 265 through which the tongue-like portion 210 of the electrical terminal pin 202 passes when the first and second tubular connectors 204 and 206 respectively are coupled together. This enables the tongue-like element 210 to become abuttingly disposed between arm portions 207a and 207b of the mating electrical terminal 207 to effect an electrical connection therebetween.

Figure 24:
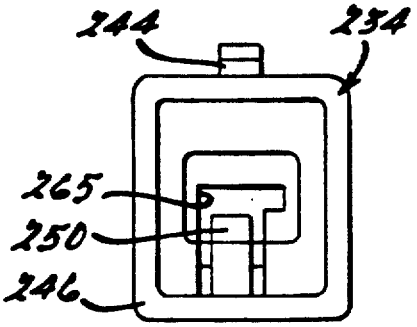
FIG. 24 is an end view of the connector of FIG. 22 as viewed from an outer end portion thereof.

With specific reference to FIG. 22, the second tubular connector 206 further includes a leaf beam portion 266 similar to leaf beam portion 254 of FIG. 19. Leaf beam portion 266 similarly enables the internal locking shoulder portion 250 to more positively engage with the mating electrical connector 207 when connector 207 is slidably inserted into the outer end portion 234 of the second tubular connector 206. With brief reference to FIG. 24, the opening 265 can be seen from the opposite end of the second tubular connector 206 (i.e., looking into the outer end portion 234 of the connector 206.

Each of the electrical connectors 204 and 206 are preferably injection molded from a suitable plastic to provide lightweight, strong components which operate to provide a secure electrical connection between at least a pair of electrical conductors.

It should be appreciated that each of the embodiments 10, 82 and 200 of the present invention illustrated herein could easily and readily be modified to accommodate varying numbers of terminal pins and terminal connectors. For example, each of the embodiments disclosed herein could readily be modified to provide "6-way" or "12-way" connector assemblies.

The connector assemblies 10, 82 and 200 of the present invention thus provide means by which two electrical conductors can be quickly, easily and conveniently coupled and uncoupled as applications so require without the need for special tools such as pliers, vice grips and/or needle nose pliers. Furthermore, the connector assemblies of the present invention operate to maintain electrical connection between two electrical conductors even in the event of vibration, jarring, etc., which would normally otherwise cause temporary or permanent uncoupling of heretofore developed connector assemblies. The connector assemblies of the present invention are further substantially unaffected by relatively hot or cold temperatures, as well as humidity, and are relatively inexpensive to construct.

The connector assemblies of the present invention have the further advantage of being readily applicable to multiple position applications. In addition, the connector assemblies of the present invention can be easily re-tooled to accept widely varying terminal pin and tubular electrical terminal diameters, such as diameters of 0.045, 0.062, 0.090 and 0.110 inches.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An electrical connector assembly comprising:

a first tubular connector having an inner end portion and an enlarged, grippable outer end portion, an elongated tubular body portion having a generally square cross sectional shape, and interior and exterior surfaces, said exterior surface having a protruding locking tab catch portion and said interior surface having a protruding internal locking shoulder portion, said elongated tubular body portion being operable to receive therethrough an elongated electrical terminal pin having a slot, said slot being adapted to lockably engage said protruding internal locking shoulder portion to secure said electrical terminal pin therein;

a second tubular connector having an elongated tubular body portion having a generally square cross sectional shape and an elongated, tongue-like element, said elongated tongue-like element further having a tab element protruding therefrom, said elongated tubular body portion further having an inner end portion and an enlarged, grippable outer end portion, sand inner and outer surfaces, said inner surface of said elongated tubular body portion having an internal, locking shoulder portion operable to lockably, abuttingly engage a shoulder portion of a mating electrical terminal when said mating electrical terminal is inserted into said outer end portion of said elongated tubular body portion to thereby captively hold said mating electrical terminal securely within said elongated tubular body portion of said second tubular connector; and whereby said elongated tubular body portion of said second tubular connector may be slidably inserted within said inner end portion of said elongated tubular body portion of said first tubular connector, thereby causing said elongated electrical terminal pin and said mating electrical terminal to matingly engage, and whereby said tab element of said elongated tongue-like element is operable to abuttingly engage with said locking tab catch portion to thereby releasably secure said first and second tubular connectors together in mating electrical and mechanical engagement;

wherein said body portion of said first tubular connector further comprises a slot disposed parallel to a longitudinal axis of said body portion and extending from said inner end portion of said body portion at least part way along said body portion; and wherein said body portion of said second tubular connector further comprises an elongated, protruding rib portion disposed parallel to a longitudinal axis of said body portion of said second tubular connector and extending along at least a portion of the length of said body portion of said second tubular connector, said rib portion and said slot being operable to engage in a key-like fashion when said first and second tubular connectors are slidably coupled together to thereby help prevent axial rotation of said second tubular connector with respect to said first tubular connector.

2. The electrical connector assembly of claim 1, wherein said elongated tubular body portion of said first tubular connector further comprises an internal wall portion operable to limit inward travel of said elongated tubular body portion of said second tubular connector when said body portion is inserted into said elongated tubular body portion of said first tubular connector.

3. The electrical connector assembly of claim 1, wherein said elongated tubular body portion of said first tubular connector comprises a slot disposed parallel to a longitudinal axis of said elongated tubular body portion, said slot extending from said inner end portion of said body portion along at least a portion of said elongated tubular body portion; and wherein said elongated tubular body portion of said second tubular connector comprises an elongated, protruding rib portion extending along at least a portion of said body portion of said second tubular connector and disposed parallel to a longitudinal axis of said body portion of said second tubular connector, whereby said rib portion is operable to engage with said slot to help align and maintain alignment of said body portions of said first and second tubular connectors when said first and second tubular connectors are matingly coupled together.

4. An electrical connector assembly comprising:

a first tubular square connector having an inner end portion and an enlarged, grippable outer end portion, and a generally square, elongated tubular body portion having a generally square cross sectional shape, said tubular body portion having inner and outer surfaces, said outer surface having an integrally formed, spaced apart locking tab catch portion and said inner surface having a first internal locking shoulder portion, said first internal locking shoulder portion being operable to lockingly and abuttingly engage with a shoulder portion of an elongated electrical terminal pin inserted into said first tubular connector through said outer end portion thereof, to thereby captively hold said elongated electrical terminal pin therein; and a second tubular connector having an inner end portion and an enlarged, grippable outer end portion, a generally square-shaped, elongated tubular body portion, and an integrally formed, planar, elongated locking tongue portion spaced apart from said tubular body portion, said planar elongated locking tongue portion, having a tab element protruding therefrom, said elongated tubular body portion of said second tubular connector further having inner and outer surfaces, said inner surface having a second, internal locking shoulder portion operable to lockably engage with a shoulder portion of a mating electrical terminal inserted into said body portion of said second tubular connector through said outer end portion thereof to thereby captively hold said mating electrical terminal securely within said elongated tubular body portion of said second tubular connector; and whereby said elongated, tubular body portion of said second tubular connector may be slidably inserted within said inner end portion of said elongated, tubular body portion of said first tubular connector to thereby cause said elongated electrical terminal pin to be slidably inserted within said mating electrical terminal, and to thereby cause said tab element of said planar, elongated locking tongue portion to lockably, releasably engage with said locking tab catch portion of said first tubular connector, to thereby releasably secure said first and second tubular connectors in mating, electrical and mechanical engagement;

wherein said body portion of said first tubular connector further comprises a slot disposed parallel to a longitudinal axis of said body portion and extending from said inner end portion of said body portion at least part way along said body portion;

wherein said body portion of said second tubular connector further comprises an elongated, protruding rib portion disposed parallel to a longitudinal axis of said body portion of said second tubular connector and extending along at least a portion of the length of said body portion of said second tubular connector, said rib portion and said slot being operable to engage in a key-like fashion when said first and second tubular connectors are slidably coupled together to thereby help prevent axial rotation of said second tubular connector with respect to said first tubular connector; and wherein said first tubular connector comprises a leaf beam portion formed intermediate said first internal locking shoulder portion and a portion of said first elongated tubular body portion.

5. The electrical connector assembly of claim 4 wherein said elongated, tubular body portion of said first tubular connector further comprises a slot formed parallel to a longitudinal axis of said body portion and extending from said inner end portion of said body portion at least part way along said elongated, tubular body portion; and wherein said elongated, tubular body portion of said second tubular connector further comprises an elongated, protruding rib portion disposed parallel to a longitudinal axis of said elongated, tubular body portion of said second tubular connector and extending along at least a portion of the length of said elongated, tubular body portion of said second tubular connector, said rib portion and said slot being operable to engage in a key-like fashion when said first and second tubular connectors are slidably coupled together to thereby help prevent axial rotation of said second tubular connector with respect to said first tubular connector.

6. The electrical connector assembly of claim 4, wherein said first tubular connector comprises a leaf beam portion formed intermediate said first internal locking shoulder portion and a portion of said first elongated tubular body portion.

7. The electrical connector assembly of claim 4, wherein said second tubular connector comprises a leaf beam portion formed intermediate said second internal locking shoulder portion and a portion of said elongated tubular body portion of said second tubular connector.

8. An electrical connector assembly comprising:

a first tubular connector having an inner end portion and an enlarged, grippable outer end portion, and a generally square, elongated tubular body portion, said tubular body portion having inner and outer surfaces, said outer surface having an integrally formed, spaced apart locking tab catch portion and said inner surface having a first internal locking shoulder portion, said first internal locking shoulder portion being operable to lockingly and abuttingly engage with a shoulder portion of an elongated electrical terminal pin inserted into said first tubular connector through said outer end portion thereof to thereby captively hold said elongated electrical terminal pin within said first elongated tubular body portion; and a second tubular connector having an inner end portion and an enlarged, grippable outer end portion, a generally square, elongated tubular body portion, and an integrally formed, planar, elongated locking tongue portion spaced apart from said tubular body portion, said planar elongated locking tongue portion spaced apart from said tubular body portion, said planar elongated locking tongue further having a tab element protruding therefrom, said elongated tubular body portion of said second tubular connector further having inner and outer surfaces, said inner surface having a second, internal locking shoulder portion operable to lockably engage with a shoulder portion of a mating electrical terminal inserted into said body portion of said second tubular connector through said outer end portion thereof to thereby captively old said mating electrical terminal securely therein;

wherein said elongated, tubular body portion of said second tubular connector may be slidably inserted within said inner end portion of said elongated, tubular body portion of said first tubular connector to thereby cause said elongated electrical terminal pin to be slidably inserted within said mating electrical terminal, and to thereby cause said tab element of said planar, elongated locking tongue portion to lockably, releasably engage with said locking tab catch portion of said first tubular connector, to thereby releasably secure said first and second tubular connectors in mating, electrical and mechanical engagement;

and wherein said elongated tubular body portion of said first tubular connector further comprises a slot disposed parallel to a longitudinal axis of said first tubular connector and extending from said inner end portion of said elongated, tubular body portion at least part way therealong; and wherein said elongated, tubular body portion of said second tubular connector further comprises an elongated, protruding rib portion disposed parallel to a longitudinal axis of said elongated, tubular body portion of said second tubular connector and extending along at least a portion of the length of said body portion of said second tubular connector, said rib portion and said slot being operable to engage in a key-like fashion when said first and second tubular connectors are slidably coupled together to thereby help prevent axial rotation of said second tubular connector with respect to said first tubular connector: and wherein said second tubular connector comprises a leaf beam portion formed intermediate said second internal locking shoulder portion and a portion of said elongated tubular body portion of said second tubular connector.

* * * * *

UNITED STATES PATENT AND TRADEMARK OFFICE

CERTIFICATE OF CORRECTION

PATENT NO. : 5,288,243

DATED : February 22, 1994

INVENTOR(S) : James E. Mergless

It is certified that error appears in the above-indentified patent and that said Letters Patent is hereby corrected as shown below:

Col. 1, Line 9 , "120,234" should be --5,120,234--;

Col. 4 Line 20, "crimp on" should be --crimp-on--;

Col. 4, Line 39, after "FIG." insert --1--;

Col. 6, Line 35, "1" should be --16--;

Col. 9, Line 19, after "204" insert --)--;

Col. 9, Line 41, after "206" insert --)--;

Col. 10, Line 39, Claim 1, "sand" should be --and--;

Col. 12, Line 38, Claim 5, after "4" insert --,--;

Col. 13, Line 32, Claim 8, "old" should be --hold--; and

Col. 14, Line 30, Claim 8, "connector:" should be --connector;--.

Signed and Sealed this

Fourteenth Day of March, 1995

Bruce Lehman

*Attest:*

BRUCE LEHMAN

*Attesting Officer*

*Commissioner of Patents and Trademarks*